US006059581A

United States Patent [19]

Wu

[11] Patent Number: 6,059,581

[45] Date of Patent: May 9, 2000

[54] ELECTRICAL CONNECTOR WITH CONTACTS MOUNTED TO HOUSING OF THE CONNECTOR WITHOUT INTERFERENCE FIT THEREWITH AND METHOD OF ASSEMBLY OF THE CONNECTOR

[75] Inventor: Kun-Tsan Wu, Tu-Chen, Taiwan

[73] Assignee: Hon Hai Precision Ind. Co., Ltd., Taipei Hsein, Taiwan

[21] Appl. No.: 08/974,337

[22] Filed: Nov. 19, 1997

[30] Foreign Application Priority Data

Dec. 26, 1996 [TW] Taiwan ..... 85220199

[51] Int. Cl.[7] ..... H01R 9/09

[52] U.S. Cl. ..... 439/79; 439/607

[58] Field of Search ..... 439/79, 660, 607

[56] References Cited

U.S. PATENT DOCUMENTS 5,266,038 11/1993 Nakamura ..... 439/79

5,531,612 7/1996 Goodall et al. ..... 439/541.5

5,766,043 6/1998 Talend ..... 439/676

5,779,489 6/1998 Davis et al. ..... 439/79

*Primary Examiner*—Paula Bradley

*Assistant Examiner*—Katrina Davis

[57] ABSTRACT

An electrical connector includes a front shielding shell member, a front housing member, a number of contacts, a rear housing member and a rear shielding shell member. The contacts are mounted to two sides of the rear housing member to prevent the contacts from moving sideward and to and fro. The rear housing member with the contacts is then inserted into a cavity defined in the front housing member to fixedly connect therewith, whereby contact portions of the contacts extend into contact passageways defined in the front housing member and are further prevented from moving upward and downward, whereby the contacts and the front and rear housing members are all fixedly connected. Finally, the front shielding shell member is mounted to the front housing member and the rear shielding shell member is connected to the front shielding shell member to accomplish the assembly of the electrical connector.

15 Claims, 6 Drawing Sheets

ELECTRICAL CONNECTOR WITH CONTACTS MOUNTED TO HOUSING OF THE CONNECTOR WITHOUT INTERFERENCE FIT THEREWITH AND METHOD OF ASSEMBLY OF THE CONNECTOR

BACKGROUND OF THE INVENTION

1. Field of the Invention

The present invention relates to an electrical connector, particularly to an electrical connector with contacts fixed to a housing of the connector without being interferentially engaged therewith.

2. The Prior Art

Due to the development of electronic technology, a variety of connectors have been developed to meet different requirements. Contacts of the connectors are formed with a fitting portion having a barb-like structure for interferentially engaging with a housing of the connector thereby fixing the contacts to the housing. To achieve the interferential engagement while avoiding an undue deformation of the contacts, specially designed jigs or tools must be provided to precisely insert the contacts into the housing. Furthermore, the fitting portion must be formed with a precise dimension to properly interferentially engage with the housing. Such requirements increase the manufacturing cost of the connector. Prior art connectors including such contacts are disclosed in U.S. Pat. Nos. 4,842,554, 5,221,212, 5,267,882, 5,295,843 and 5,017,156 and in Taiwan Patent Application Nos. 81110335, 81217896, 82101300 and 84104611.

Hence, an improved electrical connector is needed to eliminate the above mentioned defects of current electrical connectors.

SUMMARY OF THE INVENTION

Accordingly, an objective of the present invention is to provide an electrical connector having a housing combination and a number of contacts wherein the contacts are fixed to the housing combination without any interferential engagement therewith.

To fulfill the above mentioned objective, according to one embodiment of the present invention, an electrical connector includes a front shielding shell member, a front housing member, a number of contacts, a rear housing member and a rear shielding shell member. To assemble the connector, the contacts are first mounted to two sides of the rear housing member each having a number of locating plates formed thereon to prevent the contacts from moving sideward and to and fro. The rear housing member together with the contacts is then mounted to the front housing member to further prevent the contacts from moving upward and downward, whereby the contacts are fixed to the housing combination including the front and rear housing members without any interferential engagement therewith. Thereafter, the front shielding shell member is fixed to the front housing member together with the rear housing member and the contacts. Finally, the rear shielding shell member is connected to the front shielding shell member to accomplish the assembly of the connector in accordance with the present invention.

DETAILED DESCRIPTION OF THE PREFERRED EMBODIMENTS

Reference will now be made in detail to the preferred embodiment of the present invention.

Figure 1:
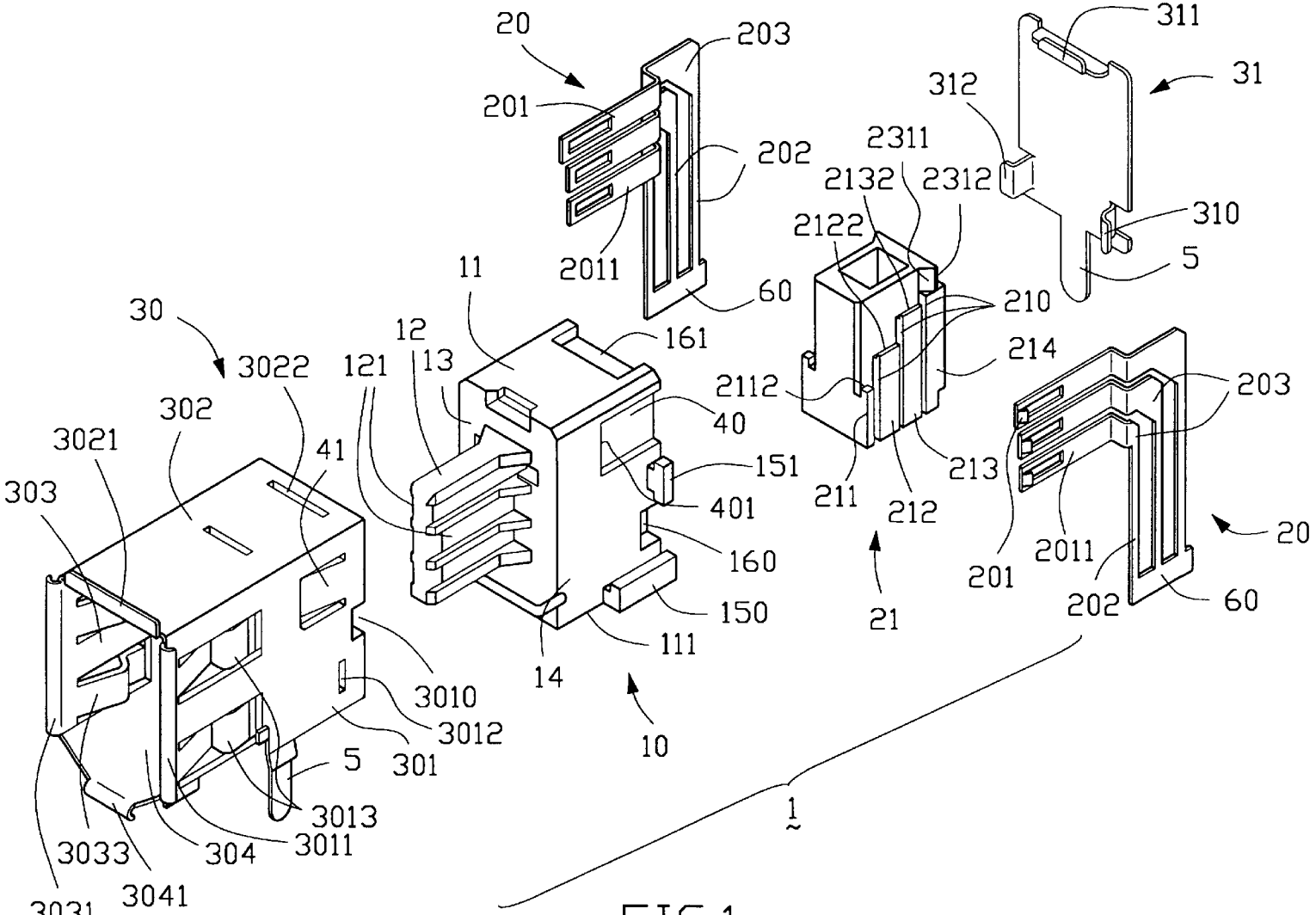
FIG. 1 is an exploded perspective view showing components constituting an electrical connector in accordance with the present invention.

Referring to FIG. 1, an electrical connector 1 in accordance with the present invention includes a front shielding shell member 30, a front housing member 10, a rear housing member 21, two contact sets 20 and a rear shielding shell member 31.

The front shielding shell member 30 is formed by stamping a metal sheet to have a substantially hollow rectangular configuration, consisting of right, top, left and bottom walls 301, 302, 303, 304 respectively having front ends 3011, 3021, 3031, 3041 protruding outwards and rearward to form a flared front end on the front shielding shell member 30, whereby a mated coupling connector (not shown) can be easily inserted into the connector 1 to connect therewith. The right and left walls 301, 303 each respectively form two engaging tabs 3013, 3033 each having a free end (not labeled) extending toward a rear end of the front shielding shell member 30, and a protrusion (not labeled) extending toward an inside thereof. The engaging tabs 3013, 3033 engage with the mated coupling connector to route electrostatic charges carried thereby to a ground potential before the mated coupling connector is firmly electrically connected to the electrical connector 1. The right and left walls 301 and 303 each further define a latching tab 41 near a rear edge thereof and have a free end (not labeled) extending toward the front end and inside the front shielding shell member 30. Two fixing legs 5 respectively extend downward from a bottom edge of the right and left walls 301, 303 for fixing the electrical connector 1 to a printed circuit board (PCB, not shown). The right and left walls 301, 303 each further define a vertical slot 3012, 3032 (best seen in FIG. 4) below the latching tab 41 and a recess 3010, 3030 (best seen in FIG. 4) in a rear edge thereof. A horizontal slot 3022 is defined in the top wall 302 near a rear edge thereof.

Figure 2:
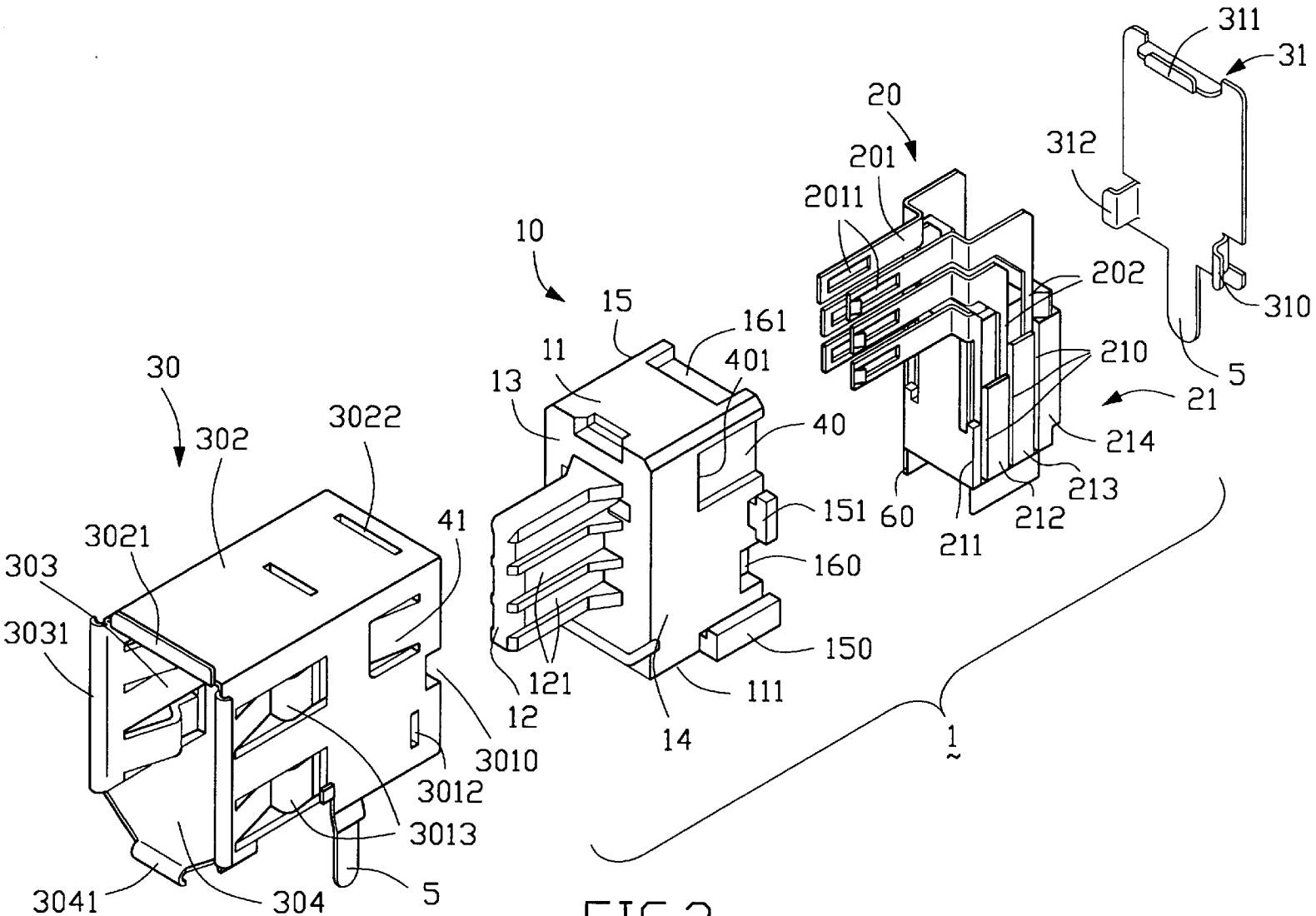
FIG. 2 is a view similar to FIG. 1, showing contacts assembled with a rear housing member at an initial position.

Referring to FIG. 2, the front housing member 10 is formed with a rear body 11 having a rectangular block configuration with a front face 13 for abutting the mated coupling connector thereby limiting the inserted distance of the mated coupling connector into the connector 1. A bottom face 111 connects to the PCB. A right and left side wall 14, 15 each have an L-shaped guiding rail 150 formed on a rear, lower part thereof, a short depression 160 defined above the rail 150, a T-shaped stop 151 formed above the short depression 160, and a long depression 40 defined above the stop 151 and having a front end 401. The body 11 further defines a depression 161 in an upper face (not labeled) at a rear edge thereof. Particularly referring to FIG. 3, a cavity 22 is defined in the body 11 opening toward the rear and bottom sides thereof. Two protrusions (not labeled and only one shown) are respectively formed on an inner face of the right and left side walls 14, 15 projecting toward the inner space 22. Each protrusion defines a first ramp 2321 and a stop face 2322. Each inner face of the right and left walls 14, 15 further forms a guide 112 extending along a bottom edge thereof. The front housing member 10 further has a contact mounting seat 12 projecting from a middle portion of the front face 13 of the body 11. The seat 12 has two side faces (not labeled) each defining three contact receiving passageways 121 communicating with the cavity 22.

Referring back to FIG. 1, each contact set 20 includes three contacts 201 sharing a common blank 60. Each contact 201 includes a contact portion 2011, a terminal portion 202 perpendicular to the contact portion 2011 and a connecting portion 203 joining the contact portion 2011 with the terminal portion 202.

The rear housing member 21 has a rectangular block configuration with a right and left side wall (not labeled) each forming thereon four locating plates 211, 212, 213, 214 having top ends configured in a steplike arrangement and cooperatively defining three locating channels 210. The top ends of each locating plate 211, 212 and 213 respectively define grooves 2112, 2122, 2132. The rear housing member 21 further has a rear face (not labeled) defining a recessed upper edge 2312 (best seen in FIG. 4). Each locating plate 214 has a top end defining a second ramp 2311 in front of each lateral end of the recessed upper edge 2312.

The rear shielding shell member 31 is made by stamping a metal sheet to have a generally flat configuration and forms a top hook 311 and two side hooks 310, 312 extending forward, and a fixing leg 5 extending downward.

To assemble the connector 1, referring to FIG. 2, the contacts 201 are first mounted to the rear housing member 21 by inserting the terminal portions 202 thereof into the corresponding locating channels 210 to reach a position whereby the blanks 60 are located near a bottom face (not labeled) of the rear housing member 21. The locating channels 210 fittingly receive the terminal portions 202 of the contacts 201.

Figure 3:
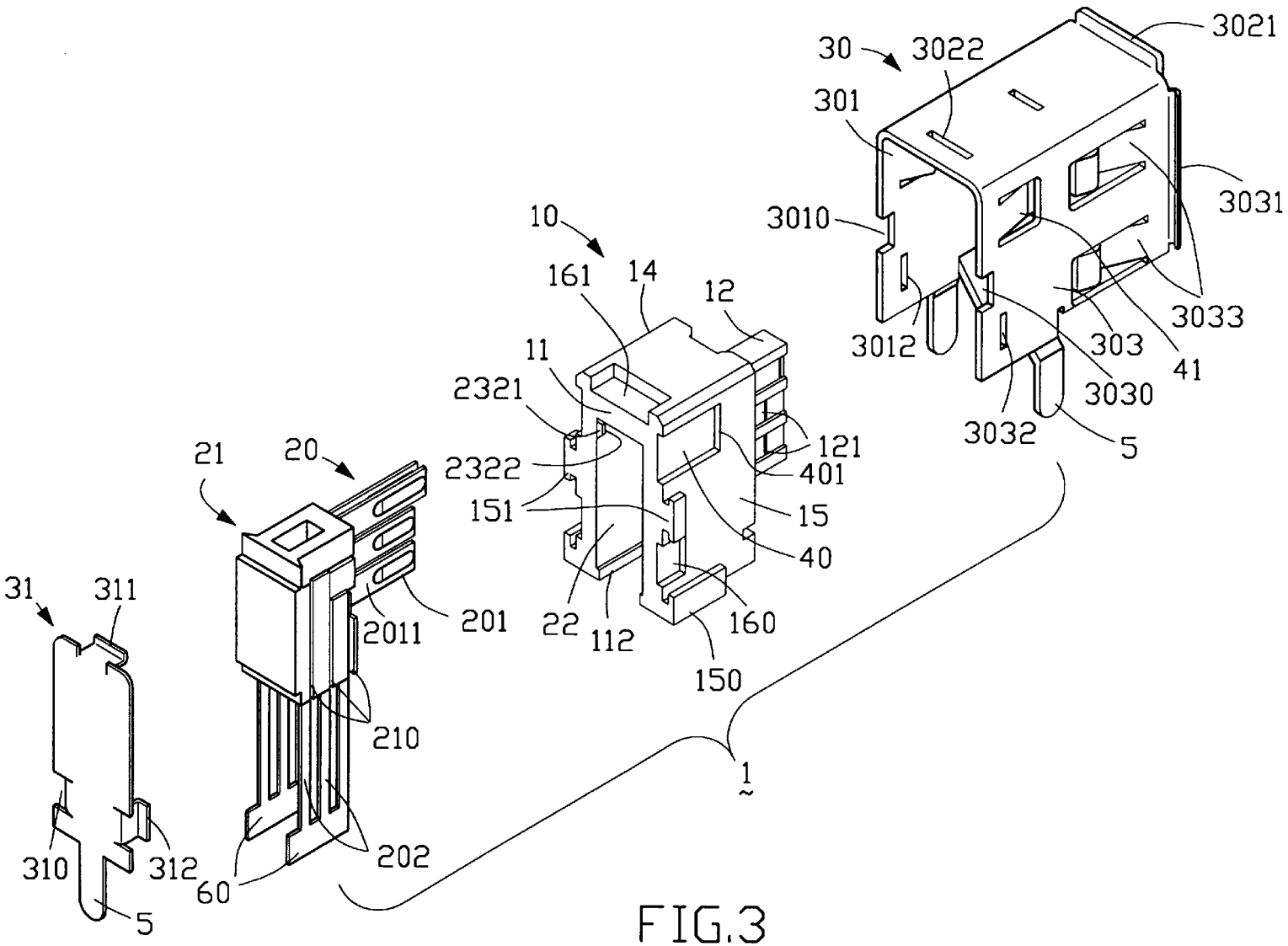
FIG. 3 is a, view similar to FIG. 2 but from an opposite direction, showing the contacts assembled with the rear housing member at a final position.

As shown in FIG. 3, the blanks 60 are then pulled downward to reach a position whereby the connecting portions 203 are respectively received in the grooves 2112, 2122 and 2132 so that the contacts 201 are prevented from moving sideward and to and fro.

Figure 4:
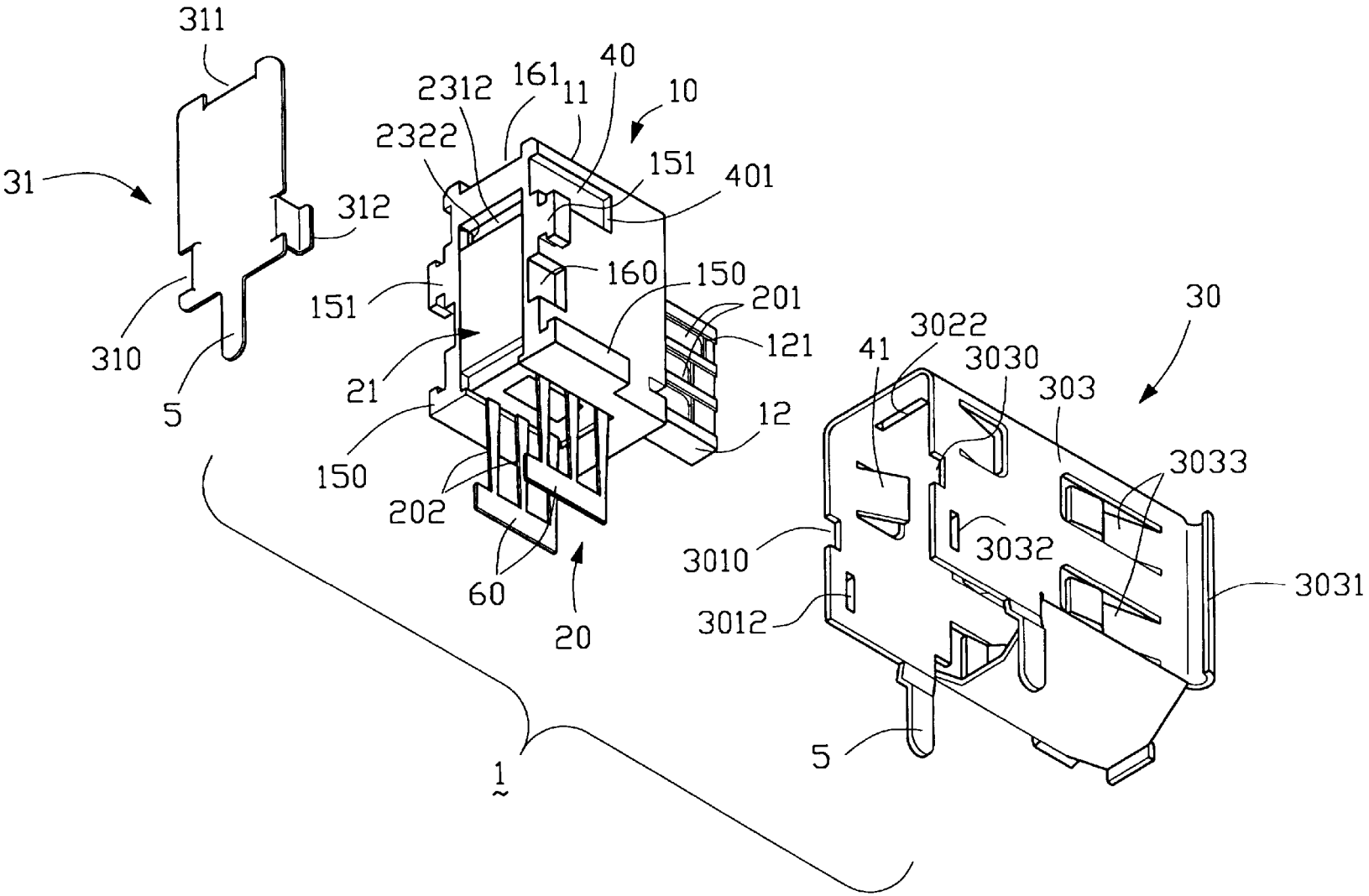
FIG. 4 is a view similar to FIG. 3, showing that the rear housing member assembled with the contacts is inserted into a cavity defined by a front housing member to fixedly connect therewith.

Thereafter, as shown in FIG. 4, the rear housing member 21 together with the contacts 201 is inserted into the cavity 22 by moving the rear housing member 21 along the guides 112 to reach a position whereby the contact portions 2011 of the contacts 201 are received in the corresponding contact passageways 121 and the recessed upper edge 2312 of the rear face of the rear housing member 21 engages the stop faces 2322 of the protrusions. Due to the mating configuration of the ramps 2311, 2321, the rear housing member 21 can be easily inserted into the cavity 22 and fixedly connect with the front housing member 10. Accordingly, the contacts 201 are further prevented from moving upward and downward thereby fixing the contacts 201 in the housing combination which includes the front and rear housing members 10, 21. After the contacts 201, the rear housing member 21 and the front housing member 10 are assembled, the common blanks 60 are cut away from the terminal portions 202 of the contacts 201.

Figure 5:
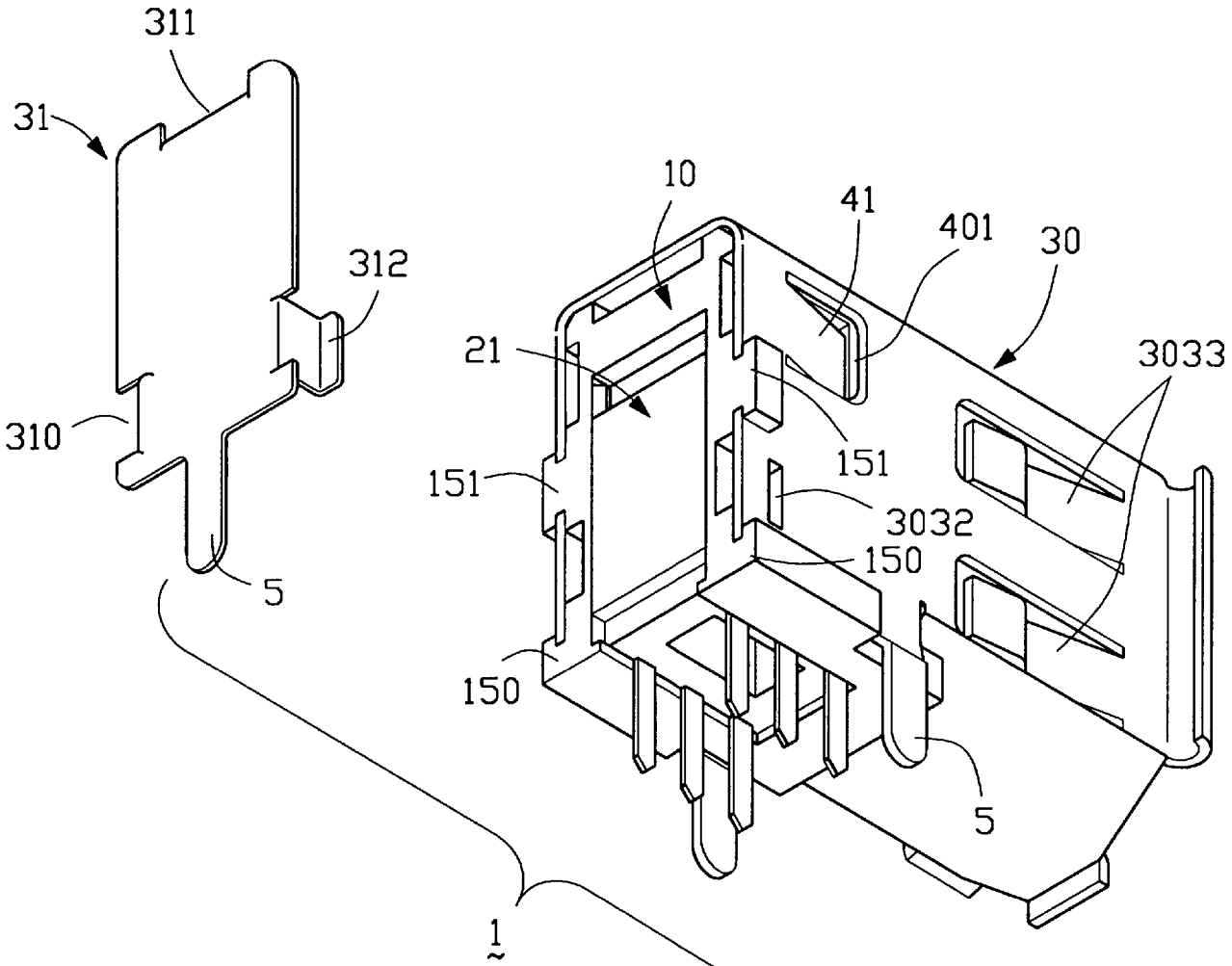
FIG. 5 is a view similar to FIG. 4, showing that the front housing member assembled with the rear housing member and the contacts is inserted into an inner space defined by a front shielding shell member to fixedly engage therewith.

Subsequently, the front shielding shell member 30 is mounted to the front housing member 10 together with the rear housing member 21 and the contacts 201 by sliding the bottom edges of the right and left walls 301, 303 along the L-shaped rails 150 to reach a position whereby the T-shaped stops 151 are received in the recesses 3010, 3030 defined in the right and left walls 301, 303, the latching tabs 41 are received in the long depressions 40 defined in the right and left side walls 14, 15 of the body 11 of the front housing member 10, and the free ends of the latching tabs 41 abut the front ends 401 of the long depressions 40. Thus, the front housing member 10 and the contact portions 2011 of the contacts 201 are fixedly received in an inner space (not labeled) defined by the front shielding shell member 30 as shown in FIG. 5.

Figure 6:
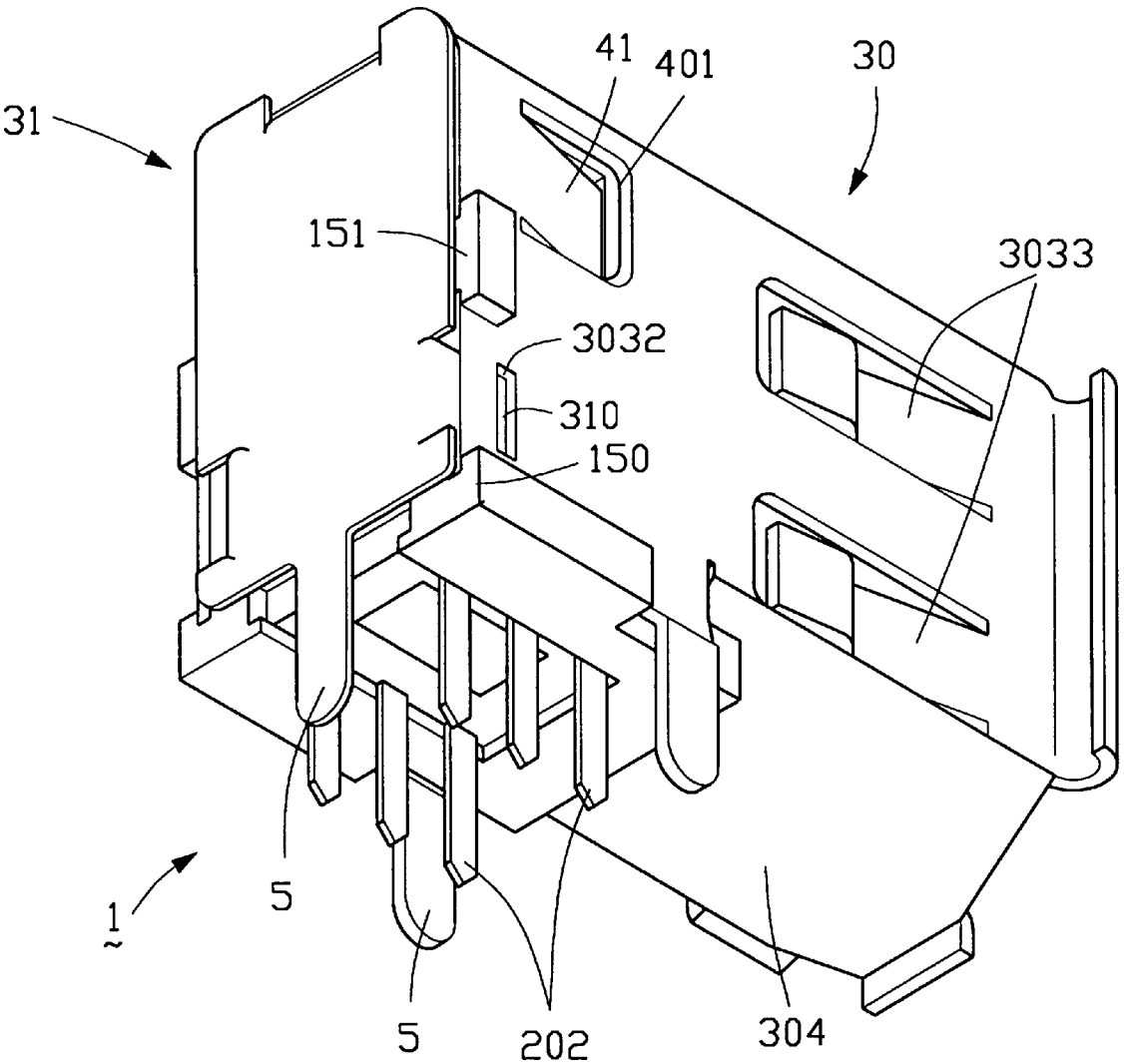
FIG. 6 is a view similar to FIG. 5, showing that a rear shielding shell member is connected to the front shielding shell member to complete the assembly of the electrical connector in accordance with the present invention.

Finally, as shown in FIG. 6, the rear shielding shell member 31 is mounted to the front shielding shell member 30 together with the front housing member 10, the rear housing member 21 and the contacts 201 by inserting the upper and side hooks 311, 310, 312 into the recesses 161, 160, respectively, causing free ends of the hooks 311, 310, 312 to extend through the slots 3022, 3012, 3032 defined in the top, right and left walls 302, 301, 303 of the front shielding shell member 30 to engage therewith, whereby the rear shielding shell member 31 is fixedly connected to the front shielding shell member 30, and the assembly of the electrical connector 1 is completed.

The construction of the present invention detailed in the above descriptions has not been taught by the prior art. Also, the contacts 201 in accordance with the present invention are fixed to the housing combination (including the housing members 10, 21) without any interferential engagement therewith, thus, the contacts 201 in accordance with the present invention do not require a fitting portion having a barb-like structure. Furthermore, a specially designed jig or tool is not required to precisely insert the contacts into the housing. Therefore, the present invention qualifies to be granted a patent.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

It is claimed that:

1. An electrical connector, comprising:

a front housing member having a rear body defining a front face for abutting a mating connector, a rear face opposite the front face, a bottom face for connection to a printed circuit board, a top face opposite the bottom face, two side walls between the front, rear, top and bottom faces and a cavity, and a front contact mounting seat projecting from the front face of the rear body and defining a number of contact passageways communicating with the cavity;

a rear housing member fixedly received in the cavity of the front housing member and having a side wall;

a number of contacts having contact portions for engaging with corresponding contacts of the mating connector, terminal portions for connection to the printed circuit board, and connecting portions joining the contact and terminal portions, wherein the contact portions are fittingly received in the contact passageways so that the contacts are prevented from moving upwardly and downwardly;

a number of locating plates on the side wall of the rear housing member and defining a number of locating channels therebetween fittingly receiving the terminal portions of the contacts, top ends of the locating plates being configured in a step-like arrangement and fittingly engage with the connecting portion of the contacts, the top ends of the locating plates defining grooves receiving the connecting portions of the contacts.

2. The connector in accordance with claim 1, wherein the front housing member forms a protrusion on each side wall thereof, projecting into the cavity and engaging with a rear face of the rear housing member.

3. The connector in accordance with claim 2, wherein each protrusion forms a first ramp facing the rear face of the front housing member.

4. The connector in accordance with claim 2, wherein the rear face of the rear housing member has a recessed upper edge, and wherein the protrusions engage with the recessed upper edge of the rear face of the rear housing member.

5. The connector in accordance with claim 4, wherein the rear housing member forms a second ramp in front of each lateral side of the recessed upper edge of the rear face thereof.

6. The connector in accordance with claim 1 further comprising a front shielding shell member connected to the front housing member.

7. The connector in accordance with claim 6 further comprising a rear shielding shell member connected to the front shielding shell member and covering the rear faces of the front and rear housing members.

8. The connector in accordance with claim 6, wherein the two side walls of the front housing member each have an L-shaped rail, a T-shaped stop and a depression, and the front shielding shell member is formed with two side walls each having a bottom edge received in the corresponding L-shaped rail, a recess fittingly receiving the corresponding T-shaped stop and a latching tab received in the corresponding depression defined in the side wall of the front housing member, each latching tab having a free end extending toward a front end of the front shielding shell member.

9. A method for forming an electrical connector, comprising the following steps:

preparing a front housing member having a rear body defining a front face for abutting a mating connector, a rear face opposite the front face, a bottom face for connection to a printed circuit board, a top face opposite the bottom face, two side walls between the top, bottom, front and rear faces and a cavity, and a contact mounting seat projecting from the front face of the rear body and defining a number of contact passageways communicating with the cavity;

preparing a number of contacts sharing a common blank, each contact having a contact portion for engaging with a corresponding contact of the mating connector, a terminal portion for connection to the printed circuit board and a connecting portion joining the contact and terminal portions;

preparing a rear housing member having a side wall forming thereon a number of locating plates defining a number of locating channels therebetween fittingly receiving the terminal portions of the contacts, top ends of the locating plates being configured in a step-like arrangement and fittingly engaging with the connecting portions of the contacts, the top ends of the locating plates defining grooves receiving the connecting portions of the contacts;

inserting the terminal portions of the contacts into the corresponding locating channels;

moving the contacts to reach a position whereby the connecting portions are respectively received in the grooves so that the contacts are prevented from moving sideward and to and fro;

mounting the rear housing member together with the contacts into the cavity to reach a position whereby the rear housing member is fixedly connected with the front housing member and the contact portions of the contacts are fitted in the contact passageways so that the contacts are further prevented from moving vertically.

10. The method in accordance with claim 9, wherein the front housing member forms a protrusion on each side wall thereof projecting into the cavity, and the rear housing member has a rear face, and wherein the step of inserting the rear housing member into the cavity causes the protrusions to engage with the rear face of the rear housing member.

11. The method in accordance with claim 9 further comprising the following step after the rear housing member is fixedly connected with the front housing member:

removing the common blank from the contacts.

12. The connector in accordance with claim 9 further comprising the following step after the rear housing member is fixedly connected with the front housing member:

forming a front shielding shell member and connecting the front shielding shell member to the front housing member to shield the contact portions of the contacts.

13. The method in accordance with claim 12 further comprising the following step after forming the front shielding shell member:

forming a rear shielding shell member and connecting the rear shielding shell member to the front shielding shell member to cover the rear laces of the front and rear housing members.

14. The method in accordance with claim 12, wherein the two side walls of the front housing member each have an L-shaped rail, a T-shaped stop and a depression, and the front shielding shell member is formed with two side walls each having a bottom edge, a recess and a latching tab having a free end extending toward a front end of the front shielding shell member, and wherein the step of connecting the front shielding shell member to the front housing member further involves sliding the bottom edges of the two side walls of the front shielding shell member along the L-shaped rails to reach a position whereby the T-shaped stops are received in the corresponding recesses defined in the front shielding shell member and the latching tabs are received in the corresponding depressions defined in the side walls of the front housing member wherein the free ends of the latching tabs abut front ends of the depressions.

15. An electrical connector (1), comprising:

a first housing member (10) defining a number of contact passageways (121) extending in a front-to-back direction, and a cavity (22) therein;

a second housing member (21) being separate from said first housing member (10);

a number of contacts (201) each having a first portion (2011) fittingly received within a corresponding contact passageway (121), and a second portion (203);

said second housing member (21) including contact locating plates (211, 212, 213, 214) engaging with the second portion (203) of each of the contacts (201) for preventing sideward and front-to-back movements of the contacts (201).

* * * * *